US009345977B2

(12) United States Patent
Hoeting et al.

(10) Patent No.: US 9,345,977 B2
(45) Date of Patent: May 24, 2016

(54) ANIMATED FIGURE

(71) Applicant: Bang Zoom Design, Ltd., Cincinnati, OH (US)

(72) Inventors: Michael G. Hoeting, Cincinnati, OH (US); Alex Dieterle, Cincinnati, OH (US)

(73) Assignee: Bang Zoom Design, Ltd., Cincinnati, OH (US)

( * ) Notice: Subject to any disclaimer, the term of this patent is extended or adjusted under 35 U.S.C. 154(b) by 0 days.

(21) Appl. No.: 14/514,885

(22) Filed: Oct. 15, 2014

(65) Prior Publication Data

US 2015/0104995 A1 Apr. 16, 2015

Related U.S. Application Data

(60) Provisional application No. 61/961,398, filed on Oct. 15, 2013.

(51) Int. Cl.
*A63H 11/00* (2006.01)
*A63H 13/02* (2006.01)

(52) U.S. Cl.
CPC ..... *A63H 13/02* (2013.01)

(58) Field of Classification Search
CPC ..... A63H 13/02
See application file for complete search history.

(56) References Cited

U.S. PATENT DOCUMENTS

| | | | | |
|---|---|---|---|---|
| D281,890 | S * | 12/1985 | Routzong | D21/622 |
| 6,017,261 | A | 1/2000 | Wachtel | |
| 6,416,380 | B1 * | 7/2002 | Li-Wen | A63H 3/20 446/330 |
| 6,589,093 | B1 | 7/2003 | Morgan | |
| 6,645,034 | B1 | 11/2003 | Tsai | |
| 7,065,909 | B2 | 6/2006 | Snyder | |
| 7,422,506 | B2 | 9/2008 | Lund et al. | |
| 8,210,894 | B2 | 7/2012 | Chan | |
| 2014/0053786 | A1 | 2/2014 | Lee | |

* cited by examiner

*Primary Examiner* — Michael Dennis
(74) *Attorney, Agent, or Firm* — Wood, Herron & Evans, LLP

(57) ABSTRACT

A figure includes a frame having a body portion and at least two appendages extending from and fixed relative to the body portion. The body portion has an aperture positioned therein. The figure also includes a casing, a motor coupled to the casing, and a crank rotatably coupled to the motor. The crank has a crank pin that is spaced from a center of the crank and engages the aperture of the frame. When the motor is activated, the crank moves the casing relative to the frame while the frame remains substantially stationary.

20 Claims, 8 Drawing Sheets

ANIMATED FIGURE

CROSS REFERENCE TO RELATED APPLICATION

This application claims the benefit of U.S. Provisional Patent Application Ser. No. 61/961,398 to Hoeting et al., filed Oct. 15, 2013, the disclosure of which is incorporated by reference in its entirety.

TECHNICAL FIELD

This invention generally relates to an animated figure, and more particularly, to an animated figure configured to be mounted to a generally planar surface.

BACKGROUND

Although toy figures, such as stuffed animals and dolls, have proven to be extremely successful and long-lasting products, manufacturers are constantly seeking new ways to make toy figures more entertaining and amusing. Although there are many toy figures that are motorized so that the figures are capable of moving or exhibiting some sort of animation, these figures are typically configured to be used on generally horizontal surfaces, such as floors or table tops, on which the figures may move about relatively freely. In contrast, there are other toy figures, such as the Stuck on You Garfield® by Dakin®, that are configured to be mounted on non-horizontal surfaces, such as in car windows. These toy figures are typically inanimate. In this regard, toy figures configured to be mounted on a car window have served a purely decorative function. It would be advantageous to develop a motorized toy figure that is capable of animated movement while it is mounted on a surface.

SUMMARY OF THE INVENTION

According to an embodiment of the invention, a figure includes a frame having a body portion and at least two appendages extending from and fixed relative to the body portion. The body portion has an aperture positioned therein. The figure also includes a casing, a motor coupled to the casing, and a crank rotatably coupled to the motor. The crank has a crank pin that is spaced from a center of the crank and engages the aperture of the frame. When the motor is activated, the crank moves the casing relative to the frame while the frame remains substantially stationary.

According to another embodiment of the invention, a figure having an outward appearance of an animal or a doll includes a frame having a body portion and at least two appendages extending from the body portion and fixed relative to the body portion. The body portion has an aperture positioned therein. The figure also includes a casing, a motor coupled to the casing, and a crank rotatably coupled to the motor. The crank has a crank pin that is spaced from a center of the crank and engages the aperture of the frame. The figure further includes a first gear coupled to the crank, intermediate the crank and the motor, and a second gear positioned substantially perpendicular to the first gear and meshing with the first gear. The second gear has an axle extending therefrom and rotatable therewith. A body member is coupled to the axle and configured to rotate with the axle. A clutch is coupled to the axle intermediate the second gear and the body member. The clutch is configured to limit a range of rotation of the body member with the axle. When the motor is activated, the crank moves the casing relative to the frame while the frame remains substantially stationary.

BRIEF DESCRIPTION OF THE DRAWINGS

The accompanying drawings, which are incorporated in and constitute a part of this specification, illustrate embodiments of the invention and, together with the detailed description of the embodiments given below, serve to explain the principles of the invention.

DETAILED DESCRIPTION

Figure 1:
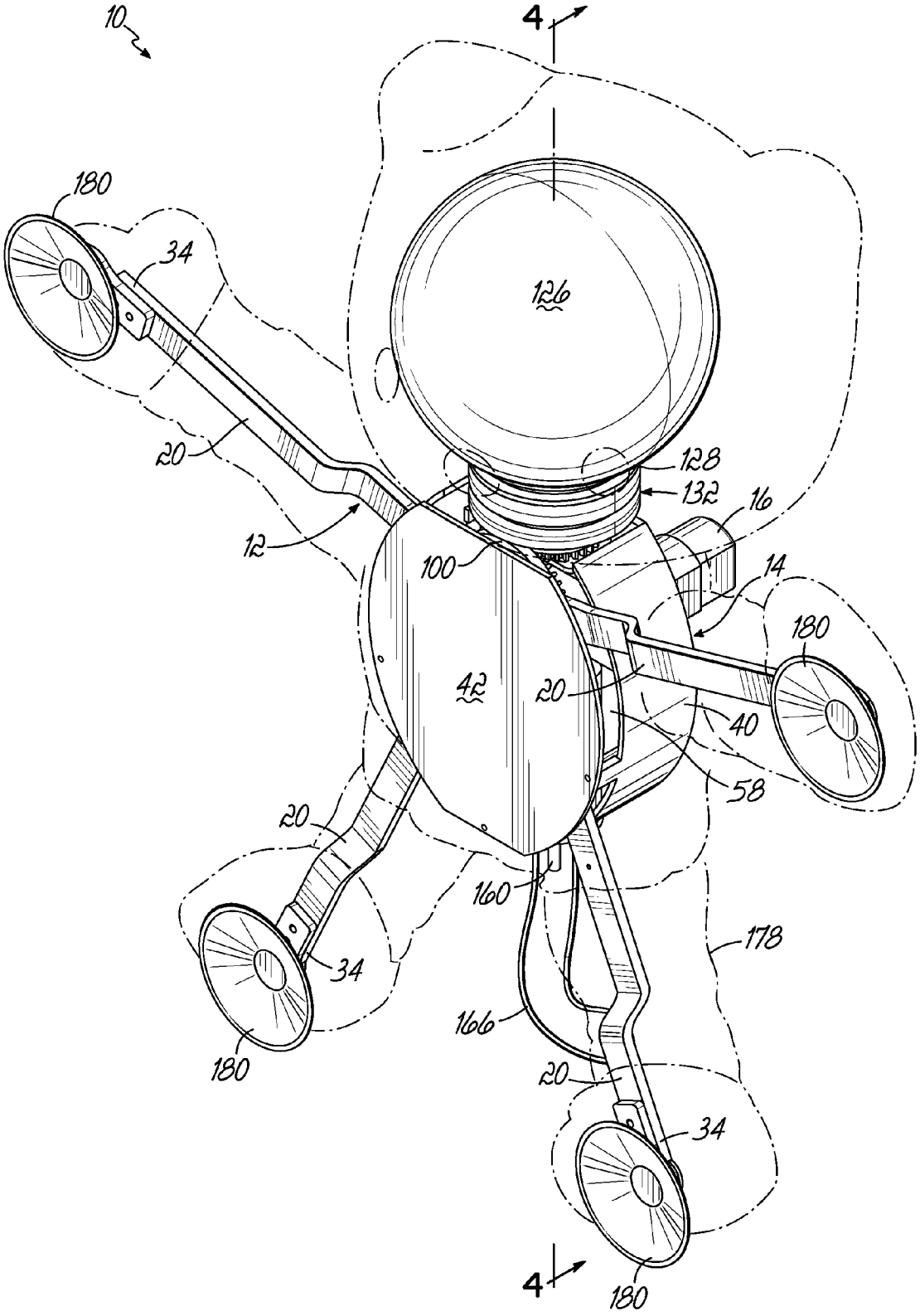
FIG. 1 is a perspective view of an animated figure in accordance with an embodiment of the invention.

With reference to FIGS. 1-5D, embodiments of an animated FIG. 10 are shown. The FIG. 10 includes a frame 12, a casing or housing 14, and a motor 16. The FIG. 10 is described herein as a toy, but the features of the FIG. 10 and various embodiments are not so limited. The FIG. 10 is configured to be releasably coupled to a generally planar surface (not shown), such as a window or a wall, for example. The planar surface could be horizontal, vertical, or some intermediate orientation.

With specific reference to FIGS. 2 and 5A-5D, the frame 12 is a substantially rigid, unitary structure that includes a body portion 18 and a plurality of appendages 20 extending from and fixed relative to the body portion 18. In the embodiment shown, the appendages 20 are formed integrally with the body portion 18. The frame 12 may be composed of plastic or another suitably rigid and lightweight material.

The body portion 18 has a front surface 22 and a back surface (not shown). The body portion 18 includes an aperture 24 that corresponds in size and shape to a crank pin (described below). In the embodiment shown, the aperture 24 is positioned in an upper region of the body portion 18. The body portion 18 further includes a slot pin 30 (FIGS. 4-5D) extending from the back surface. The slot pin 30 is sized and shaped so as to interact with a slot in a shell (described below). In the embodiment shown, the slot pin 30 is positioned in a lower region of the body portion 18.

Each appendage 20 has a distal end 34. Ends 34 of at least two appendages 20 lie in a common plane. In the embodiment shown, four appendages 20 extend from the body portion 18, and each of the ends 34 lies in a common plane. The frame 12 is substantially X-shaped, and the appendages 20 are configured to resemble arms and legs that are spread apart. However, one of ordinary skill would recognize that the frame 12 could include any number of two or more appendages 20, with any number of two or more ends 34 lying in a common plane, and with the appendages 20 arranged in a variety of configurations relative to the body portion 18.

Figure 2:
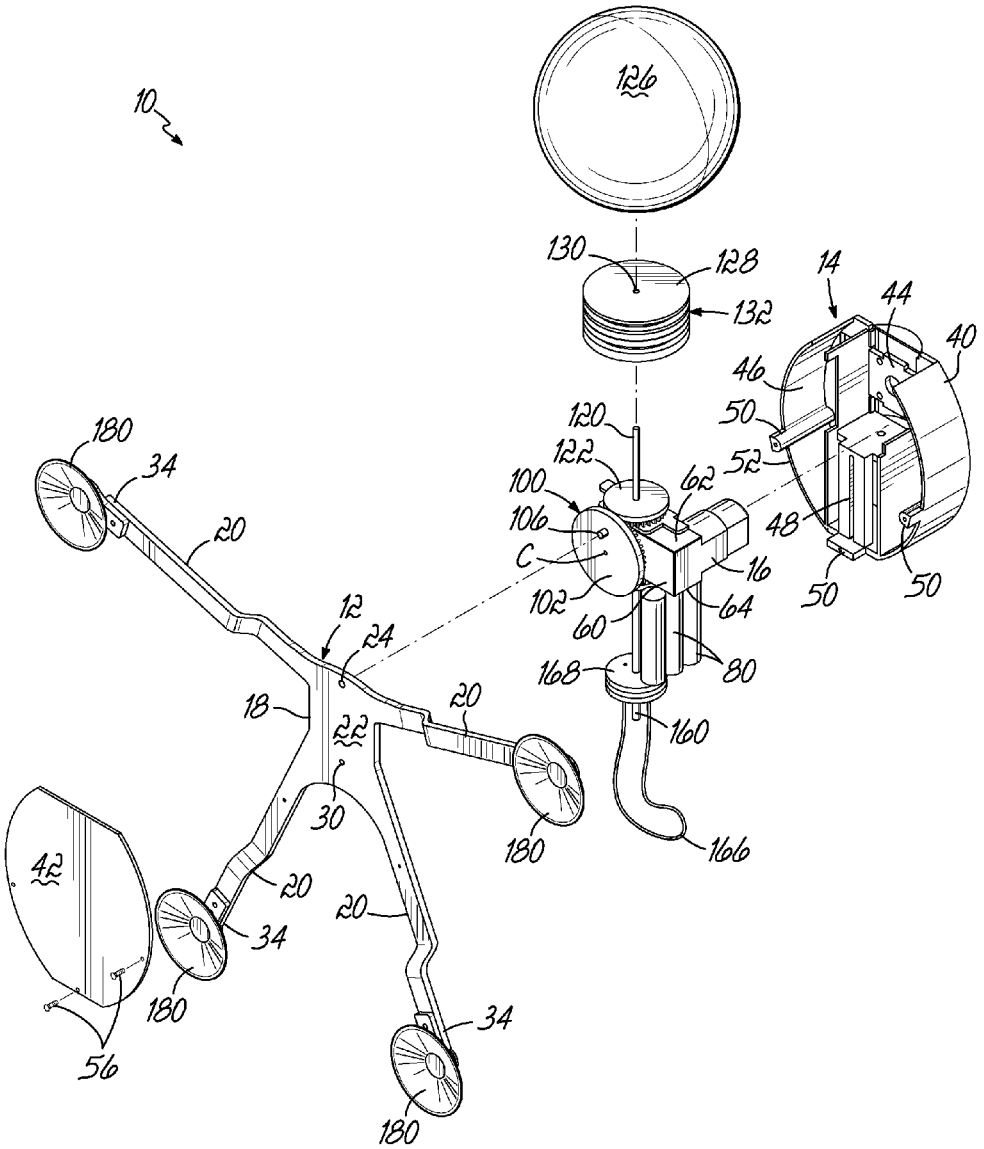
FIG. 2 is an exploded view of the animated figure of FIG. 1.

With reference to FIGS. 1 and 2, in general, the casing 14 is configured to give the appearance of a torso or a main body section of the FIG. 10. As will be described in further detail below, the casing 14 is indirectly coupled to the frame 12 so it can move relative to the frame 12. More specifically, the casing 14 may include a shell 40 and a cover plate 42. The shell 40 includes a base 44 and a wall 46 that extends from at least a portion of the periphery of the base 44. The base 44 may include various compartments or cutouts to accommodate parts housed in the shell 40. In addition, the shell 40 includes a slot 48 positioned at a lower end thereof. The slot 48 is configured to receive the slot pin 30 of the frame 12. As will be described in greater detail below, engagement of the slot pin 30 with the slot 48 restricts movement of the FIG. 10 (specifically, movement of the casing 14 relative to the frame 12). While the illustrated embodiment shows the slot 48 as vertical, which restricts lateral movement of the slot pin 30, one of ordinary skill would understand that the orientation and dimensions of the slot 48 may be altered from the embodiment shown to other desired movement restrictions of the casing 14 relative to the frame 12. For example, the slot 48 could be horizontal, which would restrict vertical movement of the slot pin 30.

A plurality of extensions 50 extends past a top edge 52 of the wall 46 at spaced intervals. Each extension 50 has a threaded bore 54 therein. The threaded bores 54 are sized and shaped to receive screws 56. In the embodiment shown, the extensions 50 are positioned at 90°, 180°, and 270°, so as to correspond to areas intermediate the appendages 20 of the frame 12. However, one of ordinary skill would appreciate that any number of extensions 50 may be used at any positions on the wall 46 that do not interfere with the appendages 20 when the FIG. 10 is in use.

The motor 16 and upper and lower gears (described below) are housed inside of the shell 40. The frame 12 is positioned intermediate the shell 40 and the cover plate 42, and the cover plate 42 is coupled to the shell 40 via the screws 56. One of ordinary skill would recognize that the shell 40 and the cover plate 42 could alternatively be coupled via a snap-fit or any other suitable means.

When the cover plate 42 is coupled to the shell 40, spaces 58 (FIG. 1) are formed between the top edge 52 of the wall 46 and the cover plate 42, except where the extensions 50 contact the cover plate 42. The appendages 20 extend through the spaces 58. The casing 14 is sufficiently larger than the body portion 18 of the frame 12 so that the body portion 18 of the frame 12 has space to move within confines of the casing 14. Similarly, the spaces 58 permit movement of the appendages 20 therein. One of ordinary skill would recognize that while the casing 14 shown in the illustrated embodiment is generally oval-shaped, the casing 14 may have any variety of shapes that accommodate the specific shape of the frame 12 and the components housed in the shell 40. The casing 14 may be formed of plastic or any other rigid, relatively lightweight material.

Figure 3:
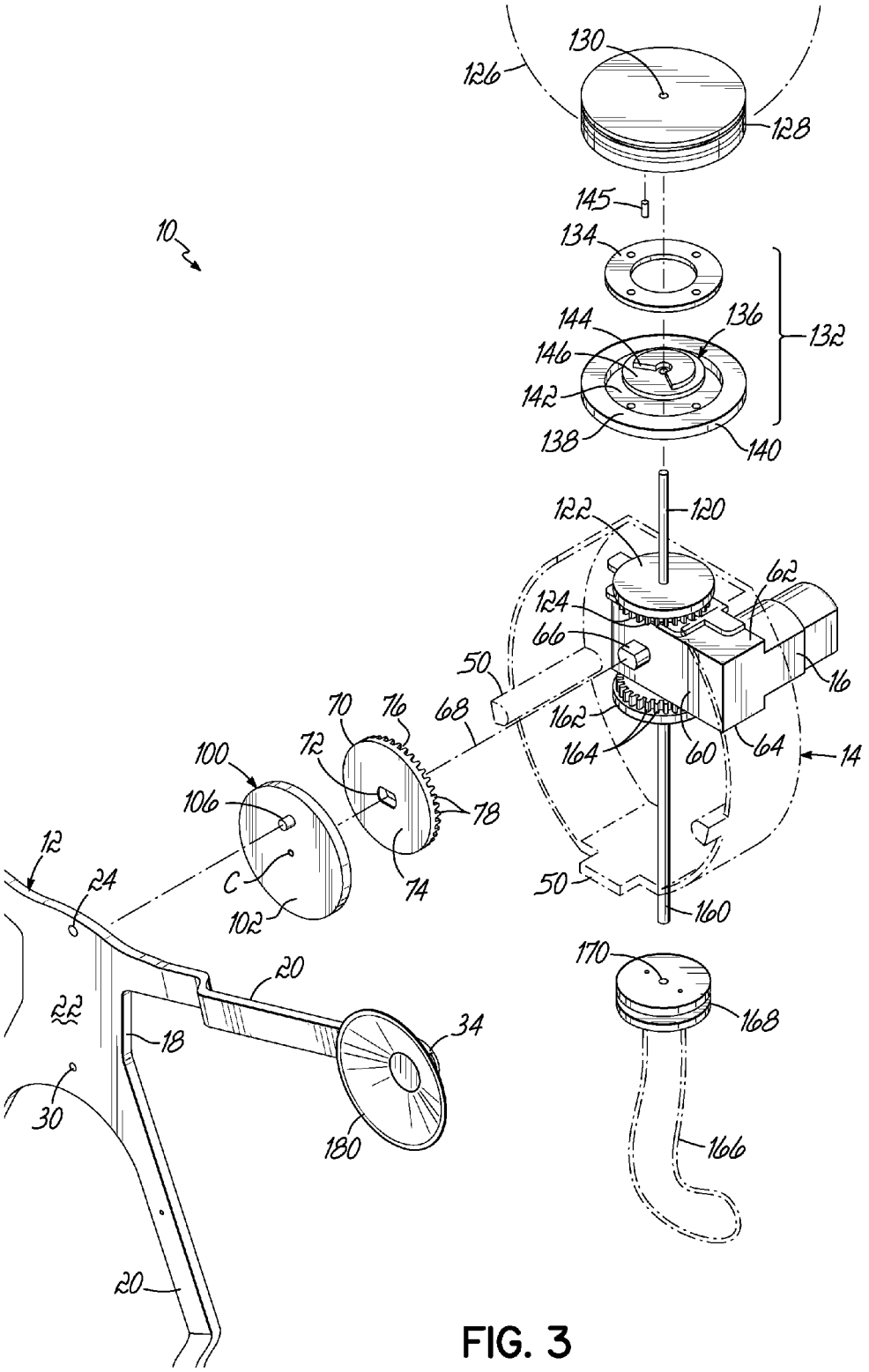
FIG. 3 is an enlargement of the exploded view of FIG. 2 showing certain elements further disassembled.

With reference to FIGS. 2 and 3, the motor 16 is generally positioned intermediate the frame 12 and the shell 40, although it may extend outside the casing 14 through a cutout (not shown) in the shell base 44. The motor 16 has a front surface 60, an upper surface 62, and a lower surface 64. A rotatable projection 66 having a keyed feature extends from the front surface 60 of the motor 16. The projection 66 is rotatably coupled to and driven by motor 16 via a gear train (not shown) located behind the front surface 60. The projection 66 defines an axis of rotation 68. In the embodiment shown, the projection 66 is generally oval-shaped.

A crown gear 70 includes an aperture 72 that is correspondingly shaped to receive the oval-shaped projection 66 and thus be driven by the motor 16. The crown gear 70 has a front surface 74 and a back surface 76. Teeth 78 are positioned on the back surface 76 around a circumference of the crown gear 70. One of ordinary skill would recognize that the projection 66 and corresponding aperture 72 could be variously shaped so long as the crown gear 70 engages the projection 66 and is driven by motor 16. Alternatively, crown gear 70 could be integrally formed with projection 66.

The motor 16 may be powered by batteries 80 or any other suitable power source. The motor 16 is capable of rotating the projection 66 in both clockwise and counterclockwise directions. The motor 16 may be programmed to automatically alternate between rotating the projection 66 in clockwise and counterclockwise directions.

A crank 100 is coupled to and rotates with the crown gear 70. The crank 100 has a front surface 102 and a back surface 104. The back surface 104 of the crank 100 is affixed to the front surface 74 of the crown gear 70, thereby coupling the crank 100 to the motor 16. In this way, rotation of the crown gear 70 is translated to the crank 100, which experiences synchronized rotation with the motor 16. While the crank 100 and the crown gear 70 are illustrated as separate pieces, the crank 100 may be permanently coupled to the crown gear 70 or formed integrally as a single piece.

With reference to FIGS. 2, 3, and 5A-5D, the crank 100 is circular and has a center C. The crank 100 has a crank pin 106 that extends from the front surface 102 of the crank 100 at a position offset from the center C and parallel to the axis of rotation 68. The crank pin 106 is configured to extend through the aperture 24 in the body portion 18 of the frame 12, thereby rotatably coupling the crank 100 to the frame 12. In this way, the crank 100 (and thus, the crown gear 70, motor 16, and casing 14) are configured to move relative to the frame 12. Because the crank pin 106 is offset from the center C, the crank 100 does not stay in an aligned position relative to the frame 12 when the crank 100 rotates. Relative positions of the crank 100 and the frame 12 are shown in FIGS. 5A-5D at different points of rotation. And because the crown gear 70, motor 16, and, ultimately, the casing 14 all move with the crank 100, the casing 14 also moves relative to the frame 12 due to interaction of the crank pin 106 with the aperture 24 of the frame 12. The further away from the center C that the crank pin 106 is located on the crank 100, the greater the degree of movement of the casing 14 relative to the frame 12.

With reference to FIGS. 3-5D, the FIG. 10 also includes an upper axle 120 and an upper gear 122 fixedly coupled to the upper axle 120. The upper axle 120 extends from the upper surface 62 of the motor 16. The upper gear 122 has teeth 124 that are positioned perpendicularly to and mesh with the teeth 78 of the crown gear 70. In this way, the crown gear 70 drives the upper gear 122 and the upper axle 120.

An upper body member 126 fixedly mounted on an upper platform 128 is also coupled to the upper axle 120. An aperture 130 disposed at a center of the upper platform 128 is shaped and sized so as to form a friction fit with the upper axle 120. The upper body member 126 may be configured to resemble a head of the FIG. 10, and, thus, movement of the upper body member 126 may resemble a motion of a turning of the figure's head.

Figure 4:
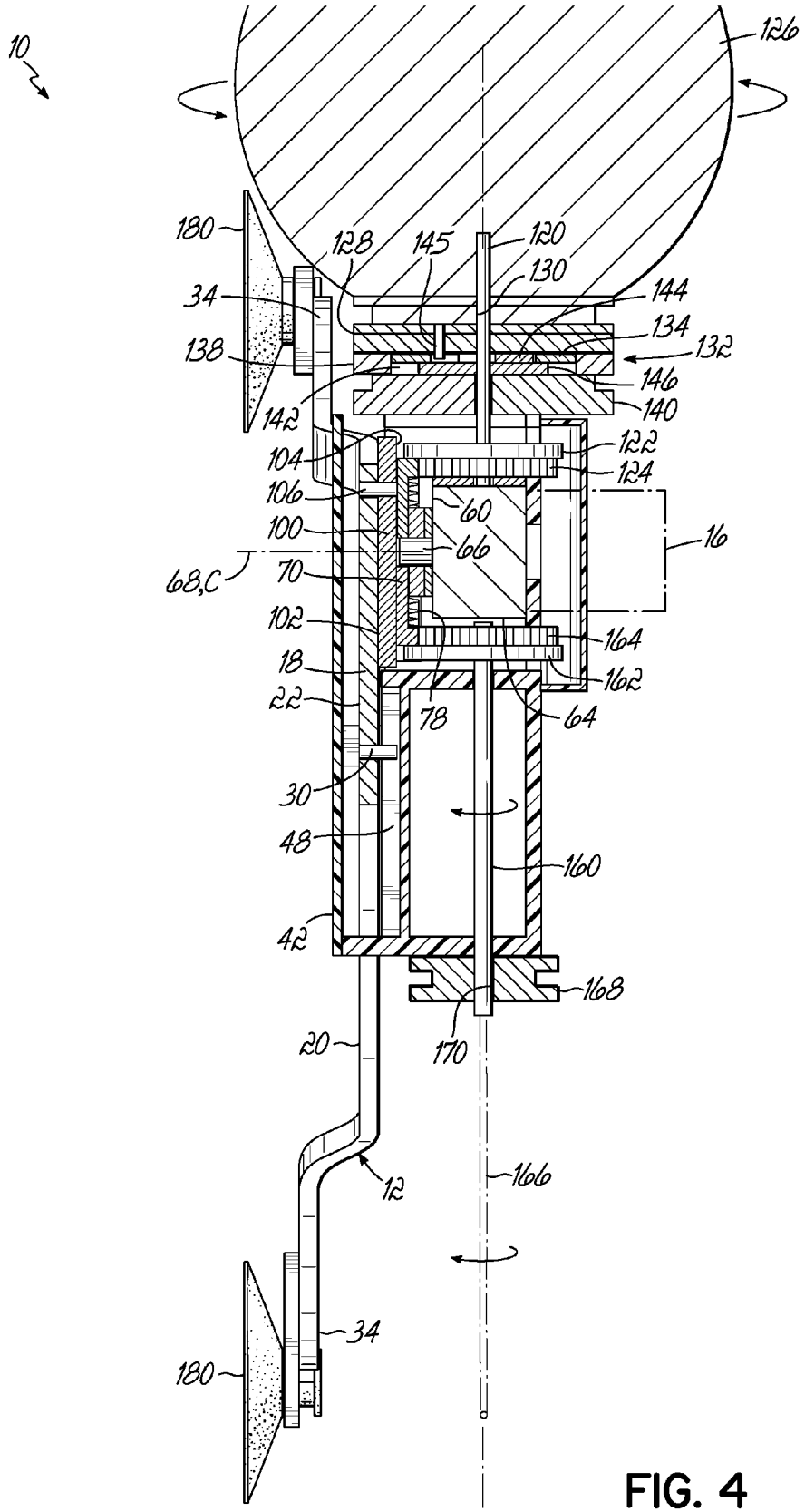
FIG. 4 is a cross-sectional view of the animated figure of FIG. 1 taken along line 4-4.

With further reference to FIGS. 3 and 4, a clutch 132 is positioned intermediate the upper gear 122 and the upper platform 128. The clutch 132 includes a screw plate 134, a rotation limit plate 136, and a pressure plate 138. Each of the screw plate 134, rotation limit plate 136, and pressure plate 138 has a central aperture therethrough so as to fit on the upper axle 120. The pressure plate 138 is positioned adjacent the upper gear 122. The pressure plate 138 is positioned stationary to the casing 14 and with a loose fit relative to the upper axle 120, such that the pressure plate 138 does not rotate with the upper axle 120. On a surface of the pressure plate 138 opposite the upper gear 122, edges 140 of the pressure plate 138 are elevated relative to a central cavity 142. The rotation limit plate 136 is positioned in the central cavity 142 of the pressure plate 138. The rotation limit plate 136 has a loose fit relative to the upper axle 120 such that the rotation limit plate 136 does not rotate relative to the upper axle 120. The rotation limit plate 136 includes a stop 144 mounted on a base plate 146. In the illustrated embodiment, the stop 144 is a substantially C-shaped portion of a non-continuous flat ring. The stop 144 interacts with a limit pin 145 on a bottom surface of the upper platform 128 to limit rotation of the upper platform 128 with the upper axle 120. As such, the upper platform 128 and, therefore, the upper body member 126, rotates with the upper axle 122 until the upper platform 128 stops. At that point, the upper axle 120 continues to rotate relative to the stopped upper platform 128. The shape of the stop 144 may be altered so as to influence a range of motion of the upper platform 128 and, thus, the upper body member 126. Lastly, the screw plate 134 is positioned intermediate the pressure plate 138 and the upper platform 128. The screw plate 134 is configured to be used to adjust pressure on the rotation limit plate 136. One of ordinary skill would appreciate that the clutch 132 may have any variety of configurations that are configured to limit a range of rotation of the upper body member 126 with the upper axle 120.

With reference again to FIGS. 3-5D, the FIG. 10 also includes a lower axle 160 and a lower gear 162 fixedly coupled to the lower axle 160. The lower axle 160 extends from the lower surface 64 of the motor 16. The lower gear 162 has teeth 164 that are positioned perpendicularly to and mesh with the teeth 78 of the crown gear 70. In this way, the crown gear 70 is configured to drive rotation of the lower gear 162 and the lower axle 160.

A lower body member 166 fixedly mounted on a lower platform 168 is also coupled to the lower axle 160. An aperture 170 disposed at a center of the lower platform 168 is shaped and sized so as to form a friction fit with the lower axle 160. In an alternative embodiment, the lower platform 168 may be fixedly coupled to the lower axle 160 and/or formed integrally with the lower gear 162. In general, the lower platform 168 is configured to rotate with the lower axle 160, so as to effect movement of the lower body member 166. The lower body member 166 may be configured to resemble a tail of the FIG. 10, and, thus, movement of the lower body member 166 may resemble a motion of a spinning of the figure's tail. In the embodiment shown, the lower body member 166 is free to continually rotate with the lower axle 160 because the lower platform 168 is not clutched like the upper platform 128. However, a mechanism similar to the clutch 132 described above with respect to the upper platform 128 could operate in the same way with respect to the lower platform 168.

One of ordinary skill would appreciate that the upper and lower gears 122, 162; upper and lower axles 120, 160; upper and lower platforms 128, 168; and upper and lower body members 126, 166 are optional features of the FIG. 10. These elements may be excluded from the FIG. 10 without affecting its operation. For example, it may not be desirable to include the lower axle 160, lower platform 168, and lower body member 166 in embodiments in which the FIG. 10 is designed to resemble an animal or a doll that does not have a tail, for example.

With specific reference to FIGS. 5A-5D, a path of movement of the casing 14 relative to the frame 12 is also affected by the interaction of the slot pin 30 of the frame 12 in the slot 48 of the casing 14. In the embodiment shown, absent interaction of the slot pin 30 in the slot 48, the casing 14 would move in an elliptical path relative to the frame 12. However, because the slot pin 30 rides in the slot 48, lateral movement of the casing 14 relative to frame 12 is restricted. Therefore, an upper region of the casing 14 has a greater range of lateral movement relative to the frame 12 than a lower region of the casing 14. Together, the crank pin 106 coupled to the aperture 24 of the frame 12 and the interaction between the slot pin 30 and the slot 48 provide an interesting, non-circular path of movement of the casing 14 relative to the frame 12. While in the embodiment shown, the slot pin 30 and the slot 48 are positioned below the crank pin 106 and the aperture 24, one of ordinary skill would appreciate that the positions of the slot pin 30 and the crank pin 106 could be reversed (i.e., to position the slot 48 above the crank pin 106) or otherwise changed so as to provide a different movement of the FIG. 10.

The FIG. 10 further includes a control (not shown) for controlling movement of the FIG. 10. The control may comprise a button, such as a push button or a toggle button, a remote control, and/or a sensor. In an embodiment including a sensor, the sensor may be activated by one or more of a motion, audible, or light stimulus. For example, the motion stimulus could comprise the waving of one's hand in front of the sensor. The audible stimulus could include clapping in the general vicinity of the FIG. 10. Or the light stimulus could include shining a light on the FIG. 10.

In an embodiment, the FIG. 10 may further comprise a sound device (not shown) for projecting music from the FIG. 10. The movements of the FIG. 10 may be coordinated with the beat of the projected music.

With reference now to FIGS. 1 and 5A-5D, all of the assembled internal components of the FIG. 10 described thus far—namely, the frame 12, casing 14, and upper and lower body members 126, 166—are encased in a material 178 that hides and protects internal components and gives the FIG. 10 the appearance of a toy, such as a stuffed animal or a doll. The material 178 may be fabric, plastic, or any other material that provides sufficient flexibility so as to not inhibit movement of the FIG. 10. In an embodiment, the frame 12, casing 14, and upper and lower body members 126, 166 may be surrounded by a plush filling (not shown), which is then enclosed in a fabric material 178. In this regard, the FIG. 10 has a look and feel of a stuffed animal. The material 178 may be decorated or embellished to achieve any desired appearance for the FIG. 10. For example, the FIG. 10 may be embellished with facial features, clothes, etc.

On the outside of the material enclosure 178, a suction cup 180 is coupled to at least two ends 34 of the appendages 20. In the embodiment shown, the suction cups 180 are coupled to the ends 34 of all four appendages 20. The suction cups 180 are configured to removably couple the frame 12 to a generally planar surface, such as a window or a wall. One of ordinary skill would further recognize that the ends 34 of the appendages 20 could have an alternative means, such as adhesive, for example, for coupling the frame 12 to the generally planar surface.

In use, one secures a FIG. 10 to a generally planar surface, such as a car window, via suction cups 180 positioned at distal ends 34 of appendages 20 on a frame 12. This embodiment will describe the FIG. 10 being secured to the inside of a car window, but one of ordinary skill would appreciate that the FIG. 10 may be secured to any generally planar surface. In this secured position, the FIG. 10 appears to cling to or hang from the window.

One then activates a control to power the motor 16. As discussed above, depending on the specific control embodiment, the control may be activated by pushing a button, sliding a switch, or clapping one's hands, for example. With reference to FIGS. 5A-5D, when the motor 16 is powered, the motor 16 causes the projection 66 to rotate in a first direction—i.e., clockwise or counterclockwise—which, in turn, rotates the crown gear 70 and the crank 100 having crank pin 106 that is engaged with the frame 12. Because the frame 12 is held substantially stationary due to the suction cups 180 being secured to the car window, rotation of the crank 100 and engagement of the crank pin 106 with the frame 12 transfers rotation of the crank 100 to the motor 16 and casing 14 coupled thereto. In an embodiment in which the motor 16 initially powers clockwise rotation of the projection 66, the casing 14, therefore, moves relative to the frame 12 in a clockwise direction and gives an appearance of a body or torso of the FIG. 10 moving relative to its arms and legs.

In addition to movement of the casing 14 relative to the frame 12, teeth 78 of the crown gear 70 mesh with teeth 124 of an upper gear 122 and teeth 164 of lower gear 162 to drive rotation of the upper and lower gears 122, 162. Rotation of the upper gear 122 causes an upper platform 128 and, ultimately, an upper body member 126 shaped like a head to rotate. Because the upper body member 126 is clutched, as described above, the upper body member 126 will rotate only until the limit pin 145 interacts with the stop 144 on the rotation limit plate 136 in the clutch 132. Even after the upper body member 126 stops rotation, the upper axle 120 continues to rotate. Similarly, rotation of the lower gear 162 causes a lower platform 168 and, ultimately, a lower body member 166 shaped like a tail to rotate.

Figure 5A:
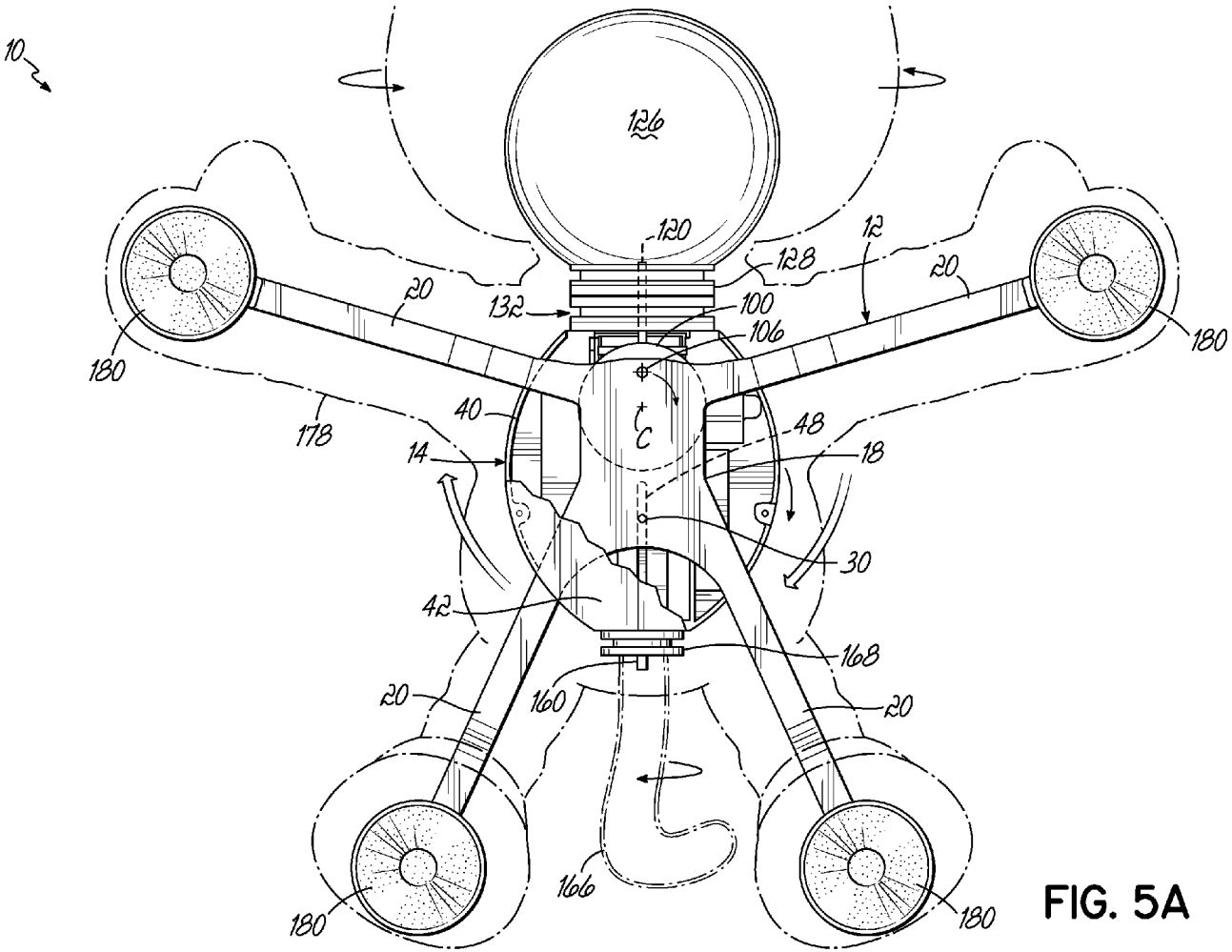
FIG. 5A is a front view of the animated figure of FIG. 1, having a portion of a casing cutaway, in a position.
Figure 5B:
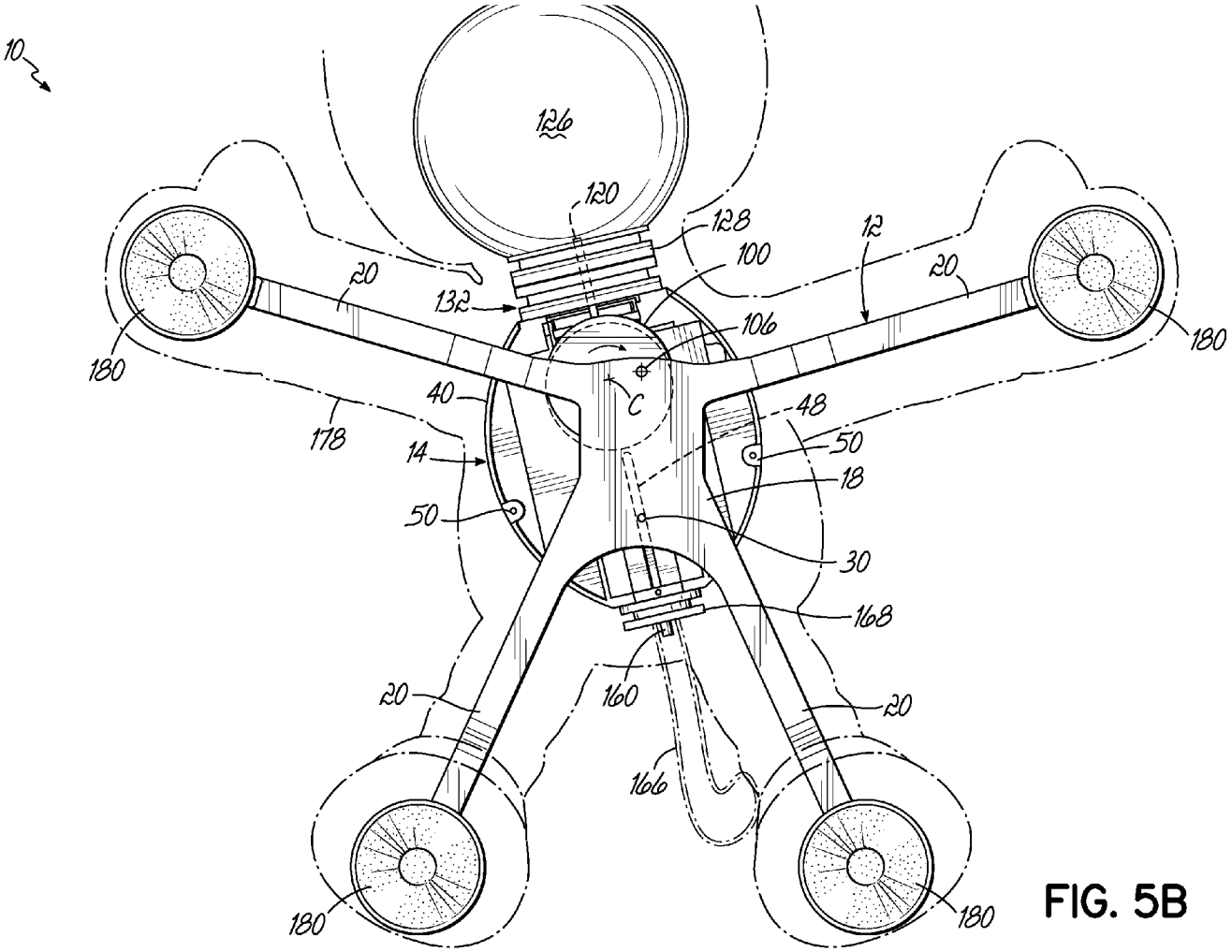
FIG. 5B is a front view of the animated figure of FIG. 1, having a portion of the casing cutaway, in another position.
Figure 5C:
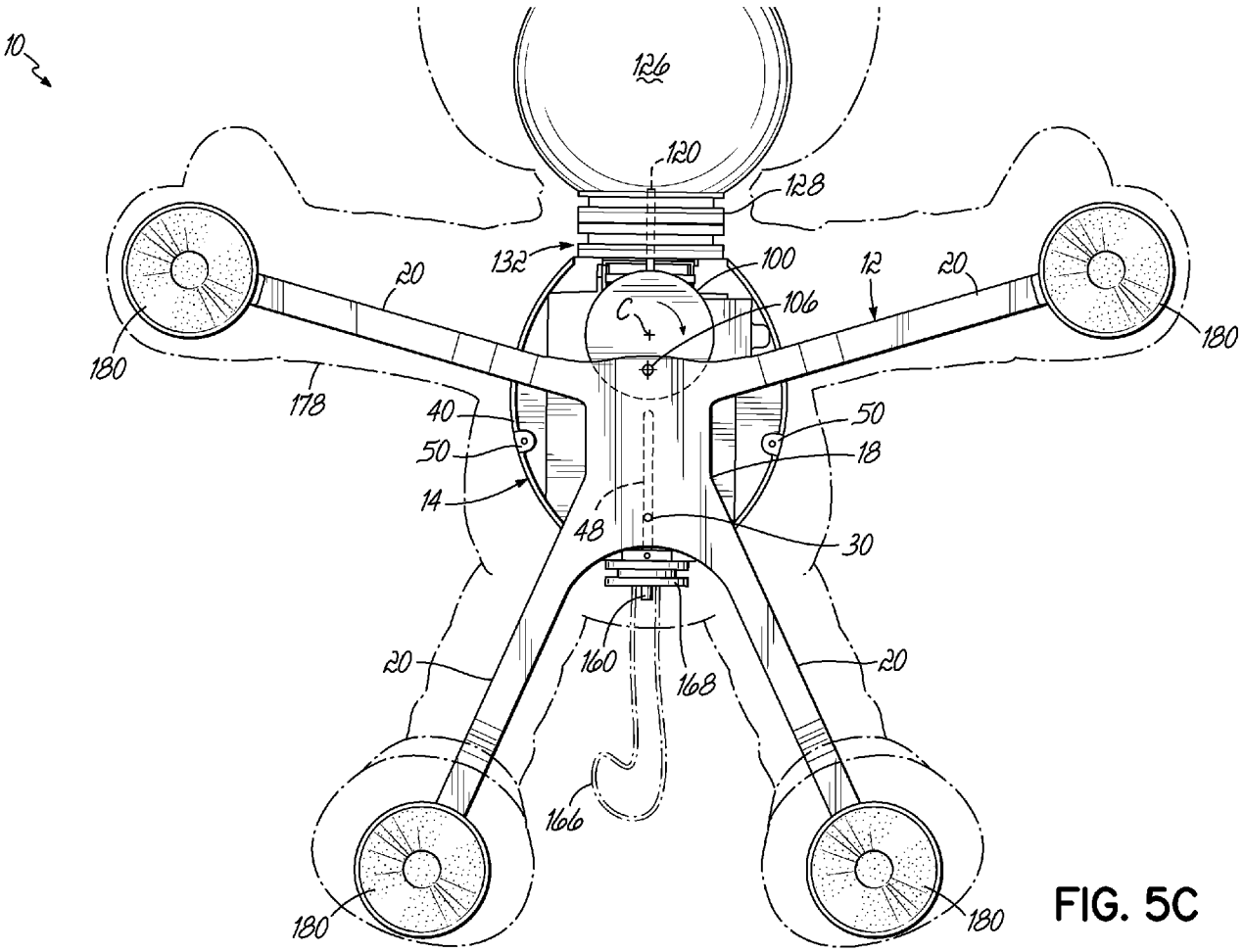
FIG. 5C is a front view of the animated figure of FIG. 1, having a portion of the casing cutaway, in yet another position.
Figure 5D:
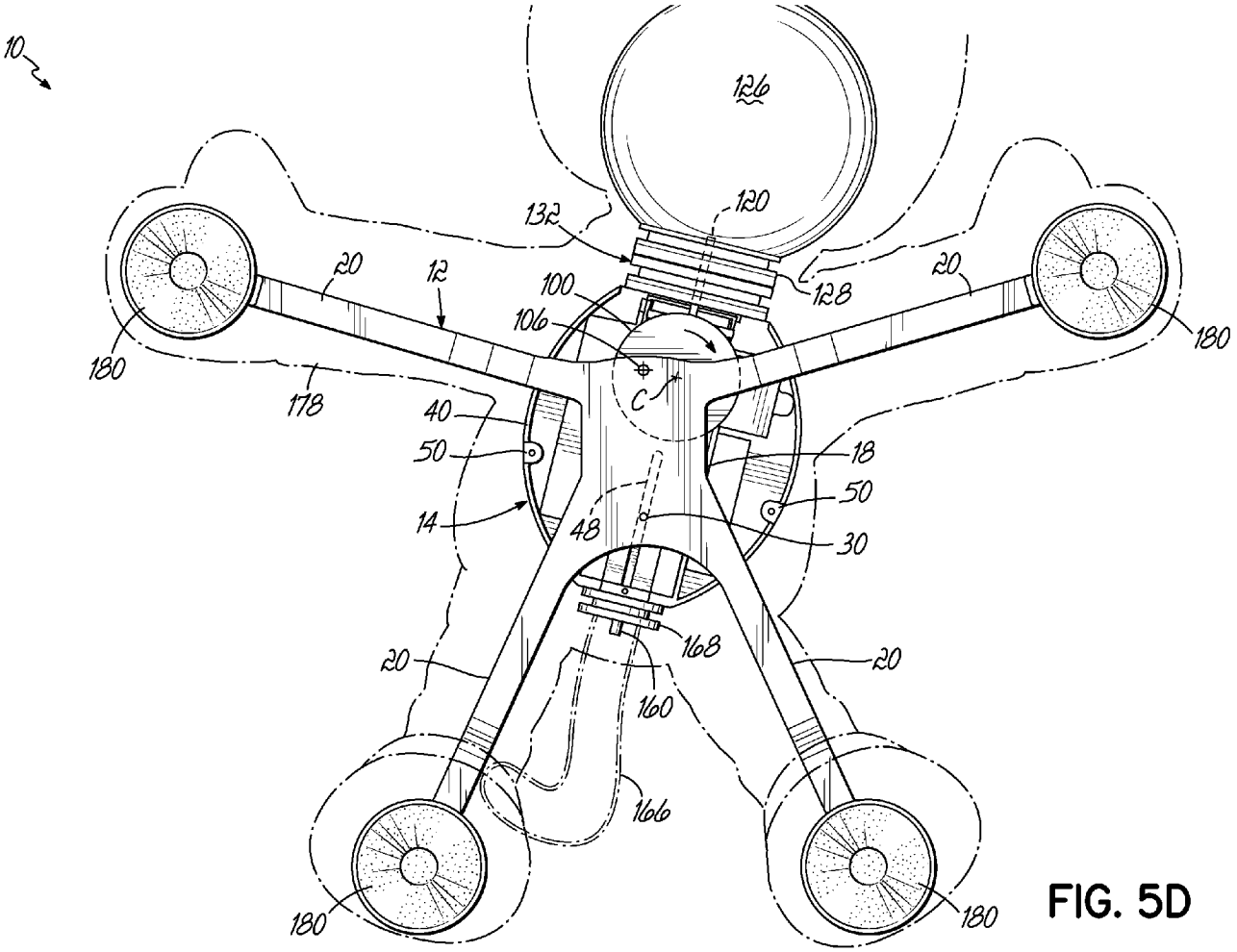
FIG. 5D is a front view of the animated figure of FIG. 1, having a portion of the casing cutaway, in still another position.

The combined tail, head, and torso movements of the FIG. 10 are shown in temporal sequence in FIGS. 5A-5D. In FIG. 5A, the crank pin 106 is at an uppermost position on the crank 100, and the slot pin 30 is near an uppermost end of the slot 48. Therefore, the casing 14 is at its lowest position relative to the frame 12. In FIG. 5B, the crank pin 106 has rotated approximately 90° in a clockwise direction from its position in FIG. 5A, so that it is positioned on one side of the crank 100. The slot pin 30 has moved downward in the slot 48 to an intermediate position. Because the slot pin 30 restricts lateral movement of the casing 14 relative to the lower portion of the frame 12, the casing 14 is askewed relative to the frame 12. In FIG. 5C, the crank pin 106 has rotated an additional approximately 90° clockwise from the position of the crank pin 106 in FIG. 5B, to its lowest position on the crank 100. The slot pin 30 is near a lowest end of the slot 48. Therefore, the casing 14 is at its highest position relative to the frame 12. In FIG. 5D, the crank pin 106 has rotated an additional approximately 90° clockwise from the position of the crank pin 106 in FIG. 5C, so that it is positioned on an opposite side of the crank 100 relative to the position of the crank pin 106 in FIG. 5B. The slot pin 30 has moved back upward to an intermediate position. Because the slot pin 30 restricts lateral movement of the casing 14 relative to the lower portion of the frame 12, the casing 14 is askewed relative to the frame 12. The combined movements may give an appearance that the FIG. 10 is dancing, for example. The dancing FIG. 10 mounted in the car window can provide entertainment to passengers of the car and any other outside observer.

The motor 16 may be programmed to automatically change a direction of rotation after a predetermined period of time or to change direction only upon activation of a control. In the embodiment described above, when the motor 16 changes direction, the projection 66 and, thus, the crown gear 70 and the crank 100 rotate in an opposite direction. The crown gear 70 then rotates the upper and lower gears 122, 162 and, thus, the upper and lower axles 120, 160 in an opposite direction. The reversed direction of rotation of the upper axle 120 releases the clutch 132 of the upper body member 126, and the upper body member 126 is free to rotate again until it reaches stop 144 on an opposite side of the rotation limit plate 136 in the clutch 132. Changing direction of the rotation of the upper and lower axles 120, 160, therefore, makes the figure's movements more dynamic. In an embodiment in which the motor 16 is programmed to change the direction of the rotation at regular, frequent intervals, the figure's movement will appear particularly erratic. The control may be used to cease operation of the motor 16, or the motor 16 may be configured to automatically turn off after a predetermined period of time.

In the embodiment in which the FIG. 10 includes a sound device, as discussed above, music may be projected when the control is activated. Moreover, the motor 16 may be programmed to change directions of rotation in a synchronized fashion with a pattern of the music.

In an alternative embodiment, rather than securing the frame 12 to the generally planar surface so that the frame 12 is held substantially stationary, the casing 14 of the FIG. 10 may be held in or otherwise coupled to a stand (not shown), such that the casing 14 (rather than the frame 12) is held substantially stationary. In this regard, in operation, the frame 12 of the FIG. 10 will move relative to the casing 14 because the crank pin 106 of the crank 100 will transfer rotation to the frame 12, which is not held stationary.

With respect to use of directional terms, such as "forward," "back," "upper," "lower," etc., it will be appreciated that such terms are intended to describe relative locations of parts comprising exemplary embodiments of the FIG. 10 in a chosen reference frame. However, it is not intended that the directional terms limit the invention to any of the exemplary embodiments or to the reference frame described herein.

While the present invention has been illustrated by the description of specific embodiments thereof, and while these embodiments have been described in considerable detail, they are not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A figure comprising:

a frame having a body portion and at least two appendages extending from and fixed relative to the body portion, the body portion having an aperture extending at least partially therethrough;

a casing;

a motor coupled to the casing; and a crank rotatably coupled to the motor, the crank having a crank pin spaced from a center of the crank and engaging the aperture of the frame, the crank pin being adapted to rotate within the aperture, wherein when the motor is activated the crank moves the casing relative to the frame while the frame remains substantially stationary.

2. The figure of claim 1, wherein the at least two appendages are configured to be removably coupled to a planar surface.

3. The figure of claim 2 further comprising:

a suction cup coupled to each of the at least two appendages.

4. The figure of claim 1, wherein when the motor is activated the casing moves in a non-circular path relative to the frame.

5. The figure of claim 1, wherein the motor is configured to move the crank in each of clockwise and counterclockwise directions.

6. The figure of claim 1 further comprising:

a first gear coupled to and rotating with the crank;

a second gear positioned substantially perpendicular to the first gear and meshing therewith, the second gear having an axle extending therefrom and rotatable therewith; and a body member coupled to the axle and configured to rotate with the axle.

7. The figure of claim 6 further comprising:

a clutch coupled to the axle intermediate the second gear and the body member, the clutch being configured to limit a range of rotation of the body member with the axle.

8. The figure of claim 6, wherein the body member is configured to resemble one of a head or a tail.

9. The figure of claim 1, wherein the motor is configured to be activated by a control, the control comprising at least one of a button, remote control, audible stimulus, or light stimulus.

10. The figure of claim 1 further comprising:

a slot positioned in the casing; and a slot pin extending from the frame and into the slot, wherein interaction of the slot pin in the slot restricts movement of the casing relative to the frame.

11. The figure of claim 1, wherein the figure is substantially encased in a material so as to give an outward appearance of an animal or a doll.

12. A figure having an outward appearance of an animal or a doll, the figure comprising:

a frame having a body portion and at least two appendages extending from the body portion and fixed relative to the body portion, the body portion having an aperture extending at least partially therethrough;

a casing;

a motor coupled to the casing;

a crank rotatably coupled to the motor, the crank having a crank pin spaced from a center of the crank and engaging the aperture of the frame, the crank pin being adapted to rotate within the aperture; and a first gear coupled to the crank, intermediate the crank and the motor;

a second gear positioned substantially perpendicular to the first gear and meshing therewith, the second gear having an axle extending therefrom and rotatable therewith; and a body member coupled to the axle and configured to rotate with the axle;

wherein when the motor is activated the crank moves the casing relative to the frame while the frame remains substantially stationary.

13. The figure of claim 12, wherein the at least two appendages are configured to be removably coupled to a planar surface.

14. The figure of claim 13 further comprising:

a suction cup coupled to each of the at least two appendages.

15. The figure of claim 12, wherein the casing moves in a non-circular path relative to the frame.

16. The figure of claim 12 further comprising:

a clutch coupled to the axle intermediate the second gear and the body member, the clutch being configured to limit a range of rotation of the body member with the axle.

17. The figure of claim 12, wherein the body member is configured to resemble a head.

18. The figure of claim 12 further comprising:

a third gear positioned substantially perpendicular to the first gear and meshing therewith, the third gear having a second axle extending therefrom and rotatable therewith; and a second body member coupled to the second axle and configured to rotate with the second axle.

19. The figure of claim 18, wherein the second body member is configured to resemble a tail.

20. The figure of claim 12 further comprising:

a slot positioned in the casing; and a slot pin extending from the frame and into the slot, wherein interaction of the slot pin in the slot restricts movement of the casing relative to the frame.

* * * * *